US005722194A

United States Patent [19]

Würger et al.

[11] Patent Number: 5,722,194

[45] Date of Patent: Mar. 3, 1998

[54] WEAPON BOLT

[75] Inventors: Franz Würger, Rottweil; Klaus Münst, Epfendorf-Harthausen, both of Germany

[73] Assignee: Mauser-Werke Oberndorf Waffensysteme GmbH, Oberndorf, Germany

[21] Appl. No.: 781,535

[22] Filed: Jan. 8, 1997

[30] Foreign Application Priority Data

Jan. 9, 1996 [DE] Germany ..... 196 00 459.4

[51] Int. Cl.[6] ..... F41A 19/27

[52] U.S. Cl. ..... 42/69.02; 89/188

[58] Field of Search ..... 42/69.02, 69.01; 89/1.42, 187.02, 188

[56] References Cited

U.S. PATENT DOCUMENTS

| | | | |
|---|---|---|---|
| 2,503,309 | 4/1950 | Weiss | 42/69.01 |
| 2,776,600 | 1/1957 | Lee | 42/69.01 |
| 3,738,219 | 6/1973 | Febres | 89/187.02 |

FOREIGN PATENT DOCUMENTS

| | | | |
|---|---|---|---|
| 36853 | 9/1981 | European Pat. Off. | 42/76.02 |
| 43 05 700 | 10/1994 | Germany . | |

*Primary Examiner*—Stephen M. Johnson
*Attorney, Agent, or Firm*—Spender & Frank

[57] ABSTRACT

A weapon bolt has a bolt head which accommodates an axially slidable firing pin and which is rotatable and displaceable parallel to the barrel axis. A bolt handle is pivotally supported on an axle carried in a radial orientation by a control sleeve which is slidable in a chamber sleeve. The bolt handle is, in a form-fitting manner, coupled to a disengagement lever supportable on the chamber sleeve and upon its actuation, causes an axial motion of the axle. The control sleeve receives an axially slidable intermediate piece which surrounds the axle and is operatively coupled at its frontal side with the firing pin and at its rearward side with a striker which arms a firing spring. In the armed state of the firing spring the striker may be locked to the chamber sleeve, via a locking arrangement, by an arming member actuated by the disengagement lever. The bolt head carries control pins which project into control cam tracks provided in the control sleeve to cause rotary motions of the bolt head during operation of the bolt handle for locking the bolt head to and releasing it from a locking member in the breech region of the weapon barrel. The control sleeve, the intermediate piece, the striker, the arming member and the locking arrangement are together axially movable by the bolt handle.

12 Claims, 4 Drawing Sheets

WEAPON BOLT

CROSS REFERENCE TO RELATED APPLICATION

This application claims the priority of German Application No. 196 00 459.4 filed Jan. 9, 1996, which is incorporated herein by reference.

BACKGROUND OF THE INVENTION

This invention relates to a bolt for a weapon, particularly a repeating weapon and is of the type that includes a bolt head which is shiftable in a chamber sleeve parallel to the barrel axis and is rotatable about its displacement axis. The bolt includes a firing pin axially displaceable within and relative to the bolt head, means which are axially movable by a bolt handle against the force of a firing spring and a sear operable by a trigger.

Bolts of the above-outlined type have been used in earlier weapons, for example, in the Swiss army rifle of the 1889/1911/1931 model and the Austrian army rifle of the 1889 model. These known bolts, however, have significant disadvantages as viewed from the present-day perspective:

The weapon may be fired when the bolt head has been accidentally removed; this poses a serious safety hazard. In all bolts, the travelled area between closing position and end position remains unutilized for the locking operation. Such a loss is particularly significant in case of a rotary angle of 90° between opening and closing. Cases of cartridges fired in a fixed position have to be withdrawn from the cartridge chamber with the application of a large force because a favorable force-transmission ratio is not available.

Further bolts having a similar construction are used in the M16 and AUG weapons. These bolts have separate bolt heads executing a small rotary motion but are, as a rule, gas-pressure operated and combined with a hammer lock. Such a lock, however, is not usable in repeating weapons because of the desired soft locking motion. A firing pin lock of known construction cannot be armed (cocked) with sufficient ease because of the small rotary angle inherent in the above-noted conventional constructions.

A bolt disclosed in German Patent No. 4,305,700 does not permit a significant increase of the locking area because the spring tongs of the locking sleeve cannot be spread arbitrarily wide. This weapon requires a separate manual arming which involves a substantial constructional outlay. Further, the bolt travels back and forth on a guide rail which involves problems in centering the bolt.

SUMMARY OF THE INVENTION

It is an object of the invention to provide an improved weapon bolt of the above-outlined type, particularly a linearly retractable bolt which is of simplified and easily operable construction and which ensures a reliable and rapid operation of the weapon.

These objects and others to become apparent as the specification progresses, are accomplished by the invention, according to which, briefly stated, the weapon bolt has a bolt head which accommodates an axially slidable firing pin and which is rotatable and is displaceable parallel to the barrel axis. A bolt handle is pivotally supported on an axle carried in a radial orientation by a control sleeve which is slidable in a chamber sleeve. The bolt handle is, in a form-fitting manner, coupled to a disengagement lever supportable on the chamber sleeve and upon its actuation, causes an axial motion of the axle. The control sleeve receives an axially slidable intermediate piece which surrounds the axle and is operatively coupled at its frontal side with the firing pin and at its rearward side with a striker which arms a firing spring. In the armed state of the firing spring the striker may be locked to the chamber sleeve, via a locking arrangement, by an arming member actuated by the disengagement lever. The bolt head carries control pins which project into control cam tracks provided in the control sleeve no cause rotary motions of the bolt head during operation of the bolt handle for locking the bolt head to and releasing it from a locking member in the breech region of the weapon barrel. The control sleeve, the intermediate piece, the striker, the arming member and the locking arrangement are together axially movable by the bolt handle.

By virtue of the arrangement according to the invention, a firing of a cartridge is not possible in case the bolt head was previously erroneously removed, because the firing pin is supported exclusively in the bolt head. It is a further advantage of the bolt according to the invention that during the rearward and forward motion of the bolt handle, the bolt head, for executing the locking and unlocking operations, is simultaneously rotated through a relatively small angle in the range of approximately 15°–30°. By virtue of such short locking or unlocking motion the loss represented by the travelled area between closing motion and end position is minimal. The locking area may be advantageously approximately one-third greater than in known bolts.

It is a further advantage of the bolt according to the invention that during the unlocking step the firing spring is simultaneously armed and locked by a striker member to the chamber sleeve. In such a secured position neither an unintentional actuation of the trigger nor an accidental firing in case of fall or impact may occur. Only immediately after insertion of a cartridge must the rifleman swing the bolt handle from its rearward repeating position into the forward locking position of the bolt head; thus, a release of the safety and a firing of the weapon is possible only in the locked position of the bolt.

Further, the manual forces to be applied to a disengagement lever arranged on the axle which supports the bolt handle are very small for the unlocking and locking operation by virtue of a favorable leverage, and particularly because even in the safe position of the firing spring the remainder of the bolt mechanism is not spring-loaded. A withdrawal of the firmly held cartridge cases is possible by a simple actuation of the bolt handle with a small manual force.

DESCRIPTION OF THE PREFERRED EMBODIMENT

Figure 1:
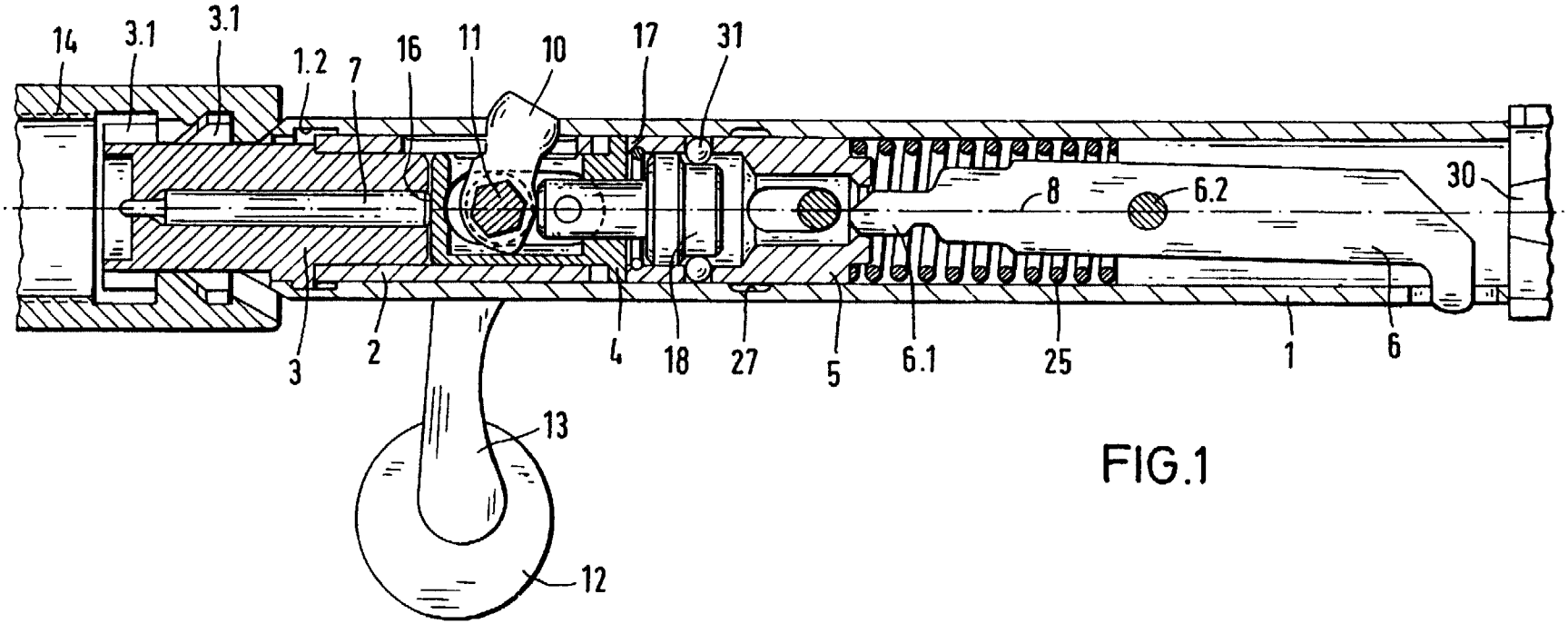
FIG. 1 is an axial sectional view of a preferred embodiment of the bolt according to the invention, shown in the locked and fired position.
Figure 3:
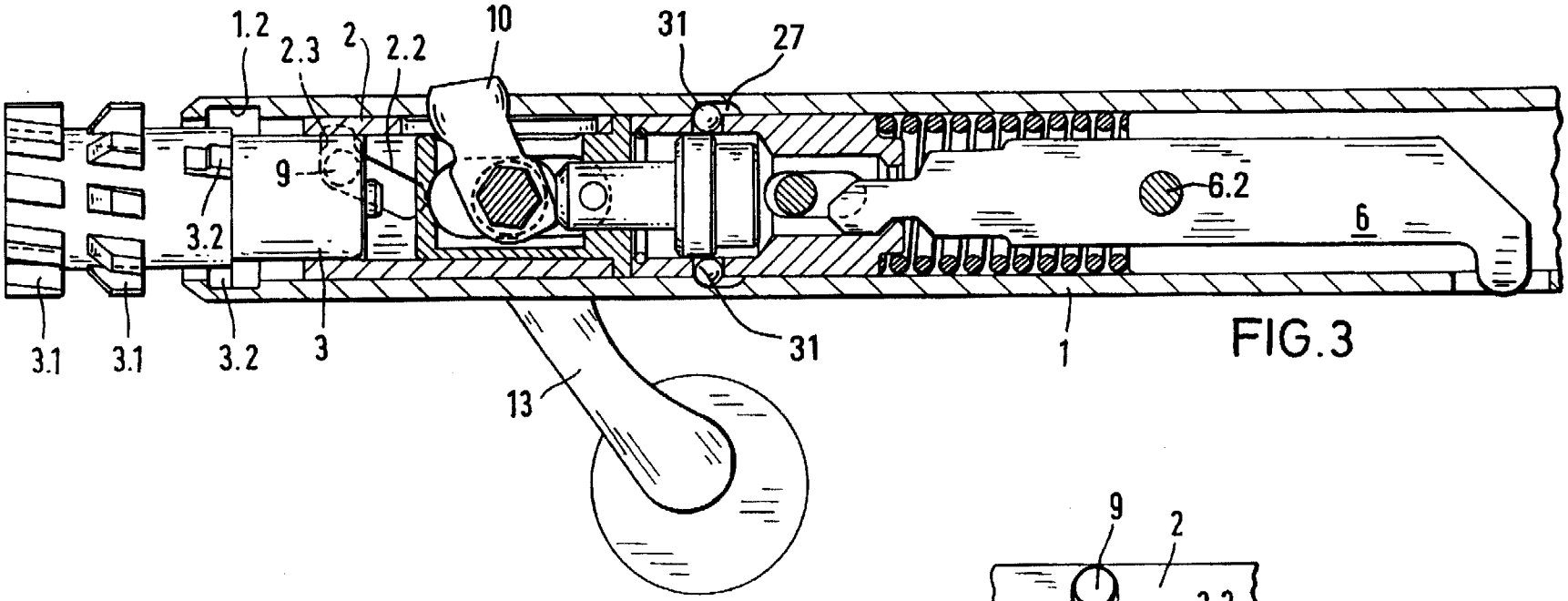
FIG. 3 is an axial sectional view of the preferred embodiment, illustrated in the unlocked (released) and armed position.
Figure 4:
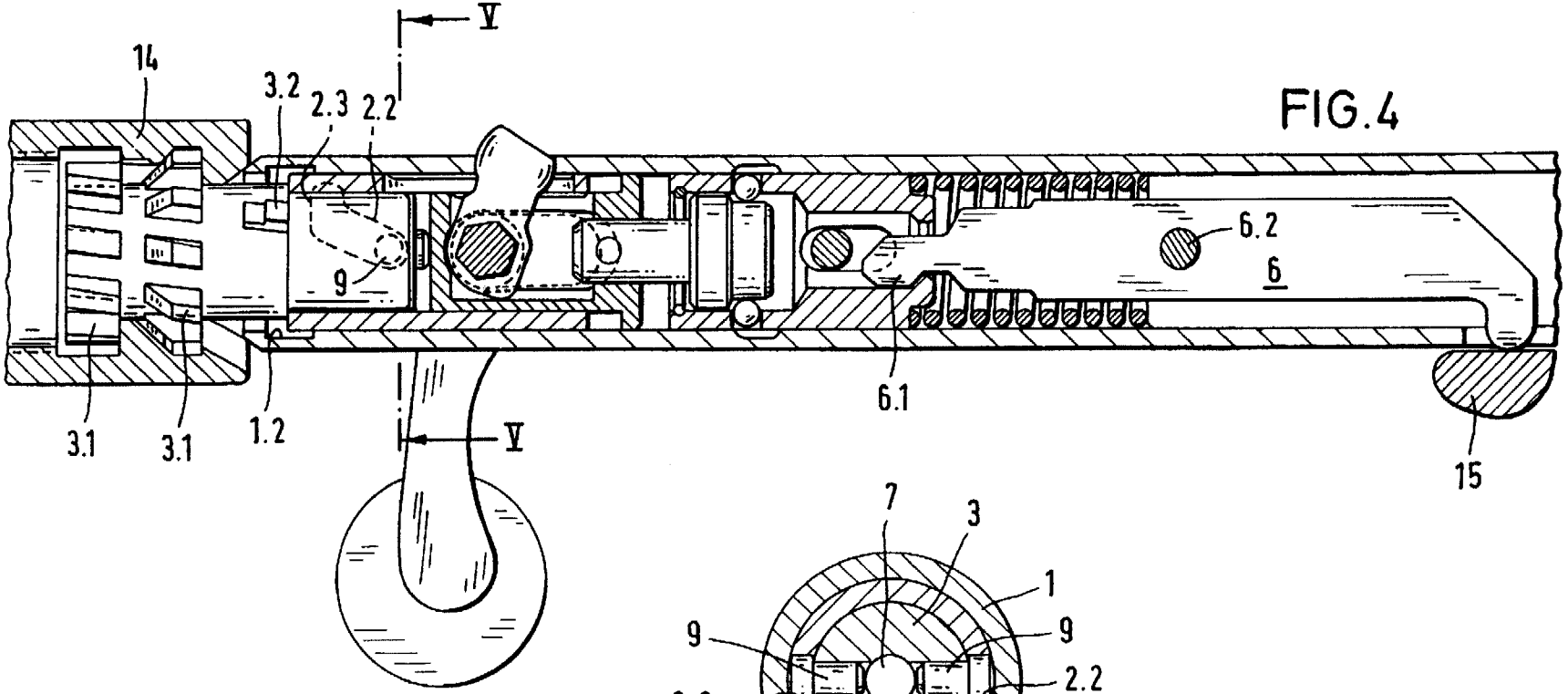
FIG. 4 is an axial sectional view of the preferred embodiment in the locked and armed position.

FIG. 1 illustrates a linearly retractable bolt which is arranged in a chamber sleeve 1 and whose frontal bolt head 3 is coupled with a locking piece 14 of the breech end of a non-illustrated weapon barrel having a barrel axis 8. At its rearward end the chamber sleeve 1 is closed with a cap 30 not illustrated in detail. The bolt head 3 has at its frontal end locking elements 3.1 which are constituted by two axially serially arranged circumferential rows of teeth 3.1 which may engage into or disengage from cooperating locking elements of the locking piece 14. As shown in FIGS. 3 and 4, the bolt head 3 has further locking elements 3.1 formed as teeth which project into a corresponding groove 1.2 of the chamber sleeve 1. By virtue of this arrangement the bolt head 3 is, relative to the chamber sleeve 1, limited (fixed) in its forward motion but is rearwardly slidably supported in the groove 1.2 provided in the wall of the chamber sleeve 1.

The bolt head 3 receives a firing pin 7 which, by non-illustrated means arranged at the rearward end of the bolt head 3, may move out therefrom as it executes its firing stroke. Behind the locking elements 3.2 the bolt head 3 is axially slidably and axially rotatably supported in a control sleeve 2 which, in turn, is slidably arranged in the chamber sleeve 1.

The axial motion of the weapon bolt is effected by a bolt handle 13 which is supported for a rotary motion in the control sleeve 2 by an axle 11 extending transversely to the barrel axis 8. The bolt handle 13 is coupled in a form-fitting manner with a disengagement lever 10 supported on the chamber sleeve 1. The disengagement lever 10 is guided in a slot 19 of the chamber sleeve 1. The supporting (guiding) faces of the slot 19 extend radially to the axis 8, and the disengagement lever 10 is of cylindrical configuration in the region of the supporting faces.

To allow the bolt handle 13 to execute a swinging motion about the slot support of the chamber sleeve 1 and to further allow the axle 11 to execute an exclusively linear motion along the axis 8, the chamber sleeve 1 and an intermediate piece 4 are provided with respective slots 1.1, 4.1, whose length is dimensioned such that the slot 1.1 makes possible the axial stroke of the swinging motion of the disengagement lever 10 supported in the slot 19 and the bolt handle 13, whereas the slot 4.1 makes possible an additional stroke of the intermediate piece 4 to release the firing pin 7. The intermediate piece 4 is axially displaceably supported inside the control sleeve 2 and surrounds the axle 11 within the slot 4.1. The front face 16 of the intermediate piece 4 is in an abutting, operative relationship with the firing pin 7. At the rearward end the intermediate piece 4 is provided with a radial flange 28 which terminates in a rear face 17 and which is bounded by the inner face of the chamber sleeve 1. The flange 28 is, with its rear face 17, in an abutting, operative relationship with the striker 5 which effects the arming of the firing spring 25 and causes the striking motion of the firing pin 7. The intermediate piece 4 has recesses which permit the motion of the disengagement lever 10 of the chamber handle 13 and the axle 11. The striker 5 is slidably supported within the chamber sleeve 1 behind the intermediate piece 4 and is, when the firing spring 25 is armed, securable to the chamber sleeve 1 with a locking arrangement 31 by means of an arming member 18 operable by the disengagement lever 10, as will be described in more detail below.

The locking means 31 is constituted by a plurality of balls each received by individual bore holes 26 provided circumferentially in the striker 5.

The arming member 18 is cylindrical; it has a frontal portion 20, a central portion 22 and a rear portion 24. The frontal and rear portions 20, 24 are stepped down relative to the central portion 22.

The frontal portion 20 of the arming member 18 is guided in the intermediate piece 4 and extends into the region of the slot 4.1 of the intermediate piece 4 for contacting a rearward slide face 21 of the disengagement lever 10.

The central portion 22 of the arming member 18 is slidably received in a bore 23 of the striker 5. The rear portion 24 supports the locking balls 31 on its periphery in the non-secured (released) state.

The frontal portion 20 accommodates a pin 29 which is oriented transversely to the barrel axis (weapon axis) 8 and which, for effecting the recuperating motion of the arming member 18, engages the rearward end of the slot 4.1 of the intermediate piece 4.

Figure 2:
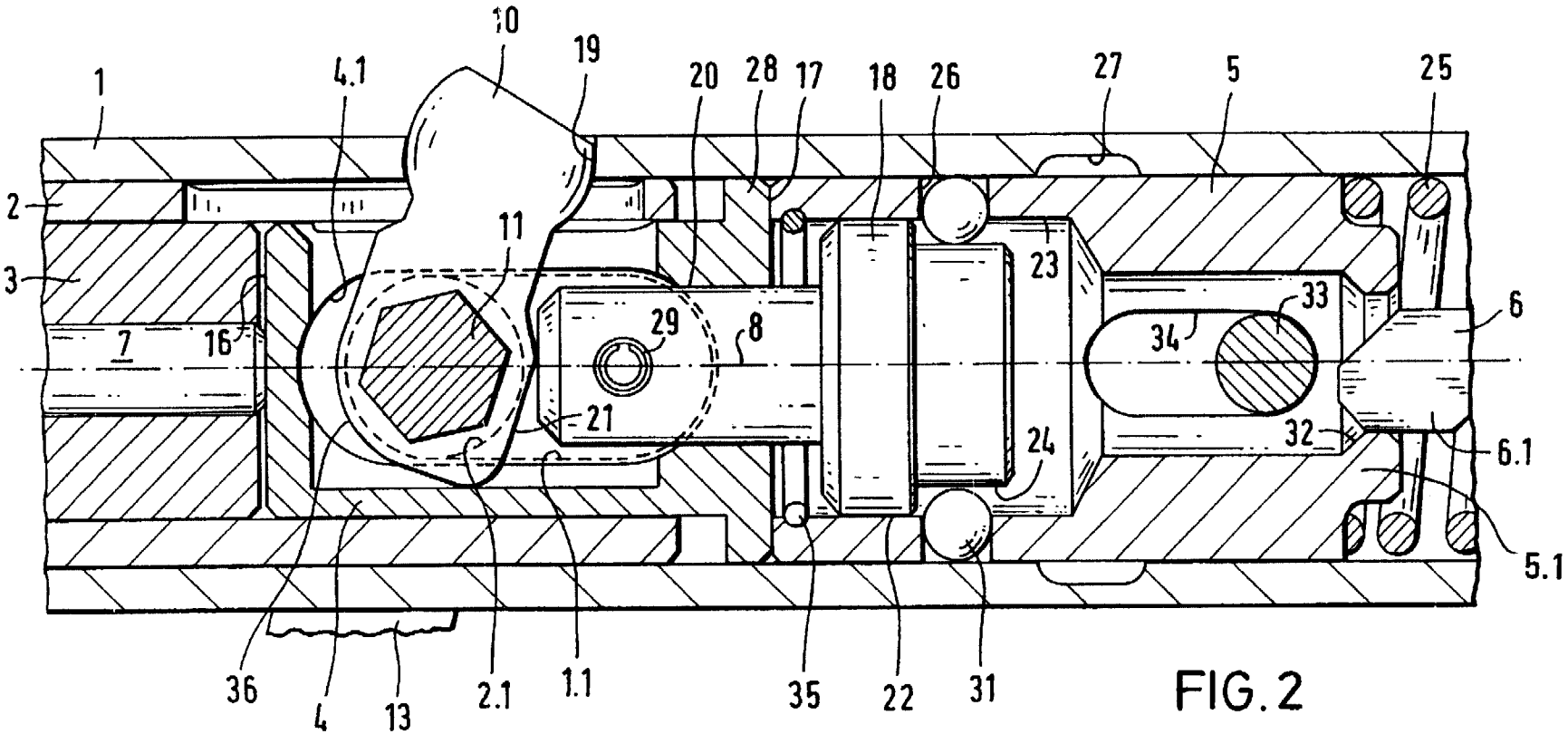
FIG. 2 is an enlarged axial sectional view of a part of the structure shown in FIG. 1.

The diameter of the balls 31 corresponds to one-half of the diametral difference between the outer diameter of the striker 5 and the outer diameter of the rear portion 24 of the arming member 18 and is greater than the thickness of the striker wall which defines the bore 23. This construction ensures that the balls 31 are, in the non-secured condition, held in their position by the rear portion 24 as shown in FIGS. 1, 2 and 4. On the other hand, as shown in FIG. 3, in the safety (blocked or secured) position, the balls 31 are held in a circumferential inner groove 27 of the chamber sleeve 1 and are supported and secured on the periphery of the center portion 22 of the arming member 18.

The striker 5 has at its rearward end a radially inwardly directed projection 5.1 which is held by a lug 6.1 of a sear 6 pivotal about an axle 6.2 and which is engageable by a trigger stud 15 as shown in FIG. 4. The axial motion of the striker 5 is limited by an axially parallel groove or slot 34 into which extends a pin 33 supported in the chamber sleeve 1. A retaining ring 35 is held in the wall of the bore 23 at the frontal end of the striker 5 for preventing the arming member 18 from dropping out of the bore 23 in a forward direction.

Figure 6:
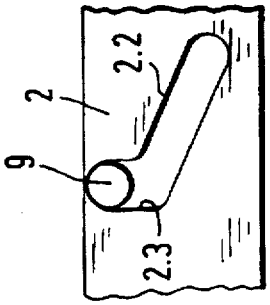
FIG. 6 is a fragmentary side elevational view of a component of the structure illustrated in FIG. 4.
Figure 5:
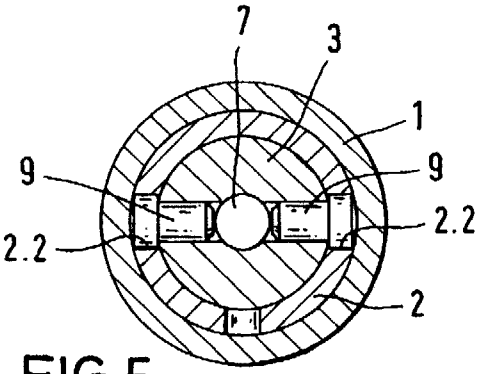
FIG. 5 is a sectional view taken along line V—V of FIG. 4.

For generating the rotary motion required for placing the bolt head 3 into a released or locked state, the bolt head 3 has control pins 9 which extend into cam tracks 2.2 of the control sleeve 2 and which effect the rotary motions of the bolt head 3 relative to the locking member 14 upon operation of the bolt handle 13. As shown in FIGS. 4, 5 and 6, the control pins 9 are arranged inside the bolt head 3 and extend transversely to the axial direction into the cam tracks 2.2 of the control sleeve 2 which are oriented obliquely to the axis 8. The oblique position of the cam tracks 2.2 relative to the axis 8 is designed such that the teeth 3.1 of the bolt head 3 may fully cover the corresponding locking elements of the locking member 14. Dependent upon the number of the locking elements which in a circumferential arrangement may be six to twelve (preferably nine) in number, then, for example, in case of a one-eighth division a rotary angle of 20° is obtained.

The teeth 3.1 on the bolt head 3 are likewise arranged obliquely to the axis 8, so that during the releasing or securing motion of the bolt head 3 into or out of the locking piece 14 situated at the end of the weapon barrel a further rotary motion of the bolt head 3 is effected. By virtue of this arrangement the control pins 9 of the bolt head 3 engage at the frontal ends of the respective cam tracks 2.2 of the control sleeve 2 in circumferentially oriented securing grooves 2.3 as illustrated in FIG. 6.

In the description which follows, the operation of the above-described weapon bolt will be set forth.

The disengagement lever 10 is turned by the axle 11 which forms a common support for the disengagement lever 10 and the bolt handle 13 and which upon operation executes both a longitudinal and a rotary motion.

If, starting from the secured and fired position (FIG. 1), the weapon bolt is to be operated, the rifleman holds the weapon with the left hand at the frontal stock and with his right hand surrounds the ball 12, forming the end of the bolt handle 13, and pulls the bolt handle 13 rearwardly. As a result of this operation, an axial motion of the axle 11, the disengagement lever 10 supported by the axle 11 and the control sleeve 2 connected with the disengagement lever 10 is effected until the rearward slide face (operating face) 21 of the disengagement lever 10 abuts the frontal end face of the frontal part 20 of the arming member 18. Then the rear face of the central part 22 of the arming member 18 presses axially against the balls 31 which, in turn, axially move the striker 5 rearwardly away from the intermediate piece 4 against the pressure of the firing spring 25. During such a rearward motion the bolt head 3 is rotated and locked by virtue of a cooperation between the cam tracks 2.2 arranged in the control sleeve 2 and the control pins 9. As seen in FIG. 3, at the end of the axial motion the balls 31 snap into the inner peripheral groove 27 of the chamber sleeve 1 and immobilize the striker 5 so that the bolt handle 13 and all the components connected therewith are released from stress.

Up to this point, the chamber sleeve 1 was prevented from executing a rearward motion because it was connected with the locking piece 14 by means of teeth 3.2 of the bolt head 3 cooperating with the corresponding groove 1.2 of the chamber sleeve 1 as well as by means of locking teeth 3.1. Since now the released position has been attained, the chamber sleeve 1 can, with all the components accommodated therein, begin its rearward motion in response to the manual pulling force. For this purpose, the locking teeth 3.1 of the bolt head 3 extending obliquely to the weapon axis 8 must be pulled through non-illustrated grooves provided in the barrel end which in the described embodiment is screw-connected as a separate locking piece 14 to the non-illustrated weapon barrel. The bolt head 3 is rotated until the control pins 9 have reached a position of rest in the securing grooves 2.3 at the end of the cam tracks 2.2 as shown in FIG. 6. In this position an unintentional rotation of the bolt head 3 during its forward motion, for example, during introduction of a cartridge into the cartridge chamber is prevented.

Upon reaching the rearward terminal position, the bolt is again pushed forward. During this occurrence the control sleeve 2 which is urged to move forward under the pressing force of the disengagement lever 10, engages the control pins 9 with those surfaces of the securing grooves 2.3 at the end of the cam tracks 2.2 which are arranged transversely to the direction of motion without being able, however, to turn the control pins 9. The pressing force is transmitted to the bolt head 3 and from there to the chamber sleeve 1 by means of the teeth 3.2 in cooperation with the groove 1.2, so that the entire bolt moves forward. At the same time, the bolt pushes the uppermost cartridge from the magazine until the obliquely oriented locking elements 3.1 enter the corresponding, non-illustrated grooves of the locking piece 14, and the control pins 9 are rotated outwardly from their secured position of rest from the securing grooves 2.3, whereupon the control sleeve 2 may slide over the bolt head 3. The control pins 9 follow the cam tracks 2.2 and accordingly rotate the bolt head 3 into the locked position. At the same time, a frontal slide face 36 of the disengagement lever 10 arrives in contact with the groove of the intermediate piece 4 and, as a result, pushes the intermediate piece 4 forward and pulls the arming member 18 forward by the pin 29 until the balls 31 leave the groove 27 of the chamber sleeve 1 and the striker 5, urged by the force of the firing spring 25, rapidly moves through a path representing the sum of the permissible tolerances until the striker 5 is caught by the lug 6.1 of the sear 6 which itself is engaged by the trigger block 15.

By virtue of a favorable ratio of the lever lengths of the bolt handle 13 to the disengagement lever 10, such as ≧2.5:1, preferably 3:1, the above-described operations may be manually easily performed and make possible the withdrawal of the firmly held cartridge cases with a small force.

It will be understood that the above description of the present invention is susceptible to various modifications, changes and adaptations, and the same are intended to be comprehended within the meaning and range of equivalents of the appended claims.

What is claimed is:

1. A weapon bolt assembly having a longitudinal axis of reciprocation, comprising (a) a chamber sleeve securable to the breech end of a weapon barrel;

(b) a locking piece securable to the breech end of the weapon barrel;

(c) a control sleeve axially slidably received in said chamber sleeve for travel in forward and rearward directions; said control sleeve having a cam track oriented obliquely to said longitudinal axis;

(d) an axle supported in said control sleeve in an orientation transverse to said longitudinal axis;

(e) a manually operable bolt handle mounted on said axle for a rotary motion thereabout; said control sleeve being axially movable by said bolt handle;

(f) a disengagement lever mounted on said axle and being affixed to said bolt handle for executing pivotal motions therewith; said disengagement lever having an actuating face;

(g) an intermediate piece received in said control sleeve for axial slidable motions relative thereto; said intermediate piece having frontal and rearward ends and an axial slot through which said axle passes;

(h) a firing spring received in said chamber sleeve;

(i) a striker received in said chamber sleeve for axial slidable motions relative thereto; said striker having a frontal end adjoining said rearward end of said intermediate piece to cooperate therewith and a rearward end engaging said firing spring for being urged forwardly by said firing spring; said striker having a forward position and a rearward, arming position in which the firing spring is compressed by said striker;

(j) a trigger;

(k) a sear movably supported in said chamber sleeve and having a holding position in which said sear retains said striker in said arming position and a releasing position in which said sear allows said striker to move forwardly urged by said firing spring;

(l) an arming member situated within said chamber sleeve for axial slidable motions relative thereto; said arming member cooperating with said frontal end of said striker and said actuating face of said disengagement lever for being axially moved rearwardly for placing said striker into said arming position;

(m) first locking means movable in a locking state by said arming member for locking said striker to said chamber sleeve in said arming position of said striker; said first locking means being movable in an unlocking state;

(n) a bolt head received in said control sleeve for axial forward and rearward movements relative thereto; said bolt head being rotatable about said axis;

(o) a control pin held in said bolt head in a substantially radial orientation; said control pin extending into said cam track provided in said control sleeve for imparting a rotary motion of said bolt head about said axis upon axial movement of said control sleeve;

(p) second locking means carried by said bolt head and cooperating with said locking piece for locking said bolt head to and unlocking said bolt head from said locking piece upon rotation of said bolt head; and (q) a firing pin received in said bolt head for axial sliding motions relative thereto; said firing pin being engageable by said intermediate piece; said control sleeve, said intermediate piece, said striker, said arming member and said first locking means being axially rearwardly movable by said bolt handle upon exerting a rearwardly directed manual force thereto.

2. The weapon bolt assembly as defined in claim 1, wherein said chamber sleeve is provided with a slot for supporting said disengagement lever; said slot having radial supporting faces, and said disengagement lever having a cylindrical portion in a region of said radial supporting faces.

3. The weapon bolt assembly as defined in claim 2, wherein said bolt handle and said disengagement lever have respective leverage length having a ratio of ≧2.5:1.

4. The weapon bolt assembly as defined in claim 3, wherein said ratio is 3:1.

5. The weapon bolt assembly as defined in claim 1, wherein said chamber sleeve and said intermediate piece have an axial slot through which said axle passes; a length of said axial slot of said chamber sleeve being designed such as to permit an axial stroke of a turning motion of said disengagement lever and said bolt handle, and a length of said slot of said intermediate piece being designed such as to permit an additional forward stroke of said intermediate piece for causing motion of said firing pin.

6. The weapon bolt assembly as defined in claim 5, wherein said arming member is cylindrical and includes (a) a central portion disposed in a bore of said striker and being slidable on a striker wall defining the striker bore;

(b) a frontal portion being guided for axial motion in a bore of said intermediate piece; said frontal portion projecting into said slot of said intermediate piece and having a frontal terminus engageable by a rearward portion of said actuating face of said disengagement lever; and (c) a rearward portion being stepped down relative to said central portion; said rearward portion supporting said first locking means in said unlocking state thereof;

further comprising a pin radially disposed in said frontal portion of said arming member and engaging a rearward end of said slot of said intermediate piece for effecting a recuperating motion of said arming member upon a forward motion of said intermediate piece.

7. The weapon bolt assembly as defined in claim 6, wherein said first locking means comprises a plurality of balls circumferentially distributed about said striker.

8. The weapon bolt assembly as defined in claim 7, wherein said striker has a plurality of circumferentially distributed holes each receiving a separate said ball; further wherein the diameter of each said ball equals one half of a diametral difference between outer diameters of said striker and said rearward portion of said arming member; further wherein the diameter of each said ball is greater than the thickness of said striker wall; further comprising a circumferential groove provided in an inner surface of said chamber sleeve; in said locking state said balls projecting into said groove of said chamber sleeve and being supported by said central portion of said arming member.

9. The weapon bolt assembly as defined in claim 1, wherein said intermediate piece includes a radial flange situated at said rearward end of said intermediate piece; said radial flange being peripherally bounded by an inner face of said chamber sleeve; said frontal end of said striker being contacted by said radial flange for causing a rearward axial movement of said arming member in response to a rearward manual force exerted on said bolt handle and for causing a forward, firing motion of said firing pin by said firing spring upon release of said trigger.

10. The weapon bolt assembly as defined in claim 1, wherein said second locking means includes a plurality of teeth extending obliquely to said axis for causing an additional rotary motion of said bolt head upon entering into or moving out of said locking piece.

11. The weapon bolt assembly as defined in claim 1, wherein said cam track has a rearward portion oriented obliquely to said axis and an adjoining, substantially circumferentially oriented frontal portion.

12. The weapon bolt assembly as defined in claim 1, wherein said sear has a lug for engaging and retaining said striker in said holding position when said striker is in said arming position and said first locking means is in said unlocking state.

* * * * *